US009625134B2

(12) United States Patent
Chien

(10) Patent No.: US 9,625,134 B2
(45) Date of Patent: Apr. 18, 2017

(54) LIGHT EMITTING DIODE DEVICE WITH TRACK MEANS

(76) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 13/367,687

(22) Filed: Feb. 7, 2012

(65) Prior Publication Data

US 2013/0201673 A1 Aug. 8, 2013

(51) Int. Cl.

| | |
|---|---|
| ***F21V 21/096*** | (2006.01) |
| ***F21V 21/088*** | (2006.01) |
| ***F21V 17/16*** | (2006.01) |
| ***F21V 21/08*** | (2006.01) |
| ***F21S 8/00*** | (2006.01) |
| ***F21V 17/10*** | (2006.01) |
| ***F21V 21/005*** | (2006.01) |
| *F21Y 101/00* | (2016.01) |

(52) U.S. Cl.

CPC ..... *F21V 21/096* (2013.01); *F21S 8/038* (2013.01); *F21V 17/104* (2013.01); *F21V 17/16* (2013.01); *F21V 21/005* (2013.01); *F21V 21/08* (2013.01); *F21V 21/088* (2013.01); *F21Y 2101/00* (2013.01)

(58) Field of Classification Search

CPC ..... F21Y 2101/02; F21Y 2103/003; F21Y 2103/00; F21Y 2113/007; F21Y 2103/10; F21Y 2115/10; F21S 4/008; F21S 2/005; F21S 8/038; F21S 8/031; F21S 4/20; F21S 4/28; F21V 15/013; F21V 14/02; F21V 21/14; F21V 19/045; F21V 1/04; F21V 21/005; F21V 9/08; F21V 21/35; F21V 29/763; F21V 19/001; F21V 21/34; F21K 9/00; H01R 25/14; H05K 3/301; B60Q 3/001; B60Q 3/0293; B60Q 3/048; G09F 9/33; F21W 2121/00; H05B 33/0857

USPC ..... 362/145–147, 249.01, 249.02, 249.03, 362/217.14, 217.15, 217.16, 219, 220, 362/276, 285, 382, 404, 418, 432, 647, 362/648, 800

See application file for complete search history.

(56) References Cited

U.S. PATENT DOCUMENTS

| | | | | |
|---|---|---|---|---|
| 4,471,415 | A * | 9/1984 | Larson et al. | 362/249.14 |
| 4,999,755 | A * | 3/1991 | Lin | 362/217.02 |
| 7,033,060 | B2 * | 4/2006 | Dubuc | 362/600 |
| 7,674,010 | B2 * | 3/2010 | Griffiths et al. | 362/249.02 |
| 7,722,230 | B2 * | 5/2010 | Chien | 362/382 |
| 7,926,985 | B2 * | 4/2011 | Teng et al. | 362/373 |
| 8,104,920 | B2 * | 1/2012 | Dubord | 362/217.12 |
| 8,109,652 | B2 * | 2/2012 | Chen | 362/249.02 |
| 8,313,213 | B2 * | 11/2012 | Lin et al. | 362/225 |
| 2006/0146531 | A1 * | 7/2006 | Reo et al. | 362/244 |

(Continued)

*Primary Examiner* — Hargobind S Sawhney
(74) *Attorney, Agent, or Firm* — Bacon&Thomas, PLLC

(57) ABSTRACT

An LED light device includes track means with removable LED-units which clip-on anywhere along the length of the track means or which may be added-on from ends of the track means to form an LED fluorescent tube, LED light bar, LED bulb, LED PL lamp, or other LED Lamp sealed inside a protective means finish the light source so that it appears similar to a non-LED light source. The removable LED-units or LED-assemblies with built-in LED elements allow people to adjust the position of the LED-units or LED-assemblies to a desired location, position, or orientation in in three dimensional space and obtain the best illumination with a minimum number of LED elements and lower power consumption.

1 Claim, 9 Drawing Sheets

(56) References Cited

U.S. PATENT DOCUMENTS

| | | | | |
|---|---|---|---|---|
| 2008/0212323 | A1* | 9/2008 | Chien | 362/250 |
| 2010/0118526 | A1* | 5/2010 | Chien | 362/230 |

* cited by examiner 1
2A
2B
2C
2D
3
4

Co-inventor's prior art and CIP and Division filing for clip-on LED- Assembly along the length of track means or add/reduce LEDs from ends.

LIGHT EMITTING DIODE DEVICE WITH TRACK MEANS

This application is a continuation-in-part of copending U.S. patent application Ser. No. 13/162,824, filed Jun. 17, 2011.

BACKGROUND OF THE INVENTION

The invention relates to a device having LED track means with removable LED-units that clip-on anywhere along the length of the track means, or that can be added—on from ends of the track means.

This application has subject matter in common with the inventor's U.S. patent application Ser. Nos. 13/296,508, 13/295,301, and 13/296,469, respectively directed to a LED bulb, light device, and lamp holder having built-in digital data means connected to a power source of the light device.

The invention further has subject matter in common with the inventor's U.S. patent application Ser. No. 13/162,824 (disclosing a light device with display means having track-means and removable LED-units), Ser. No. 12/938,628 (disclosing a LED light fixture having outlets and removable LED units), and Ser. No. 12/887,700 (disclosing a light fixture with self-powered removable LED units), as well as the inventor's U.S. patent application Ser. No. 12/149,963 (now U.S. Pat. No. 7,722,230), Ser. No. 12/073,095 (now U.S. Pat. No. 7,726,869), Ser. Nos. 12/073,889, 12/007,076 (now U.S. Pat. No. 7,726,841), Ser. No. 12/003,691 (now U.S. Pat. No. 7,726,839), and Ser. No. 12/894,865.

The light device of the current invention may be in the form of an LED bulb, LED florescent tube, or other LED light source that includes the above-mentioned LED track means with removable LED-units that clip-on anywhere along the length of the track means or that can be added—on from ends of the track means.

LED bulbs, LED fluorescent tubes, or other LED light sources currently available in the marketplace, such as the bulbs and tubes offered by Philips, Osram, or Feith, normally have special designs that provide a wide viewing angle of light and high brightness. However, each of them has a very complicated construction, resulting in high cost. The current invention reduces complexity and cost by using unique removable LED-units along with track means that (1) enable the LED units to easily be added or removed from anywhere along the length of the track means or from ends of the track means; (2) by providing only a limited number of different surface track-means, enabling construction of a wide variety of light devices of different brightness, size, diameter, length, viewing angle, and shape, to cover the full range of existing incandescent bulbs, fluorescent tubes, or other light sources, so that the consumer can find a replacement without any mistake, (3) tailor a working illumination area to a person's head or shoulder width to save power by eliminating illumination of non-working areas, (4) offer the most economical LED light source so that consumers will be willing to replace their incandescent bulbs or actual fluorescent tubes with super power-saving LED light sources and thereby reduce power consumption, save money, save energy, and save the earth.

An important advantage of the current invention is that it lets the consumer meet any requirement for brightness, illumination area, color of light, and size of illumination area by enabling the consumer itself to adjust the brightness, illumination area, color, and size of illumination area in seconds by adding, removing, and manipulating the removable LED-units and track means.

It is to be appreciated that the current invention is not to be limited by the embodiments specifically disclosed therein, and that the current invention may be modified by, for example, to incorporate construction principles disclose in the inventor's copending applications or issued patents, and that all such modifications may still fall within the scope of the current invention.

BRIEF DESCRIPTION OF THE DRAWINGS

FIGS. 1-11 to 1-18 show different sizes and arrangements for the LED-units or LED-assemblies, housing means for sealing the LED-units or LED-assemblies, and arrangement of LED-elements within each of the LED-units or LED-assemblies.

FIGS. 1-19 to 1-21 show LED-units or LED-assemblies having resilient/elastic conductive means to facilitate addition, replacement, removal, assembly, and disassembly of the LED-units or LED-assemblies to or from one or more track means having a desired geometric combination in three dimensions of positions, relations, and orientations so that the built-in LED-elements will provide predetermined light functions, performances, and light shows.

FIGS. 2 to 16 the construction of a protective means, LED-units or LED-assemblies, resilient/elastic conductive means or moveable conductive means, and track-means according to an embodiment of the invention.

FIG. 5-11 shows track means geometric arrangements in three dimensions and having minimum and maximum sizes and provide desired lighting effects, including arrangements with 3, 4, 6, and 8 track means, each track means having different LED-units or LED-assemblies with different sizes and numbers of LEDs or LED-elements arranged to form light tubes or bars of different size and shape.

DETAILED DESCRIPTION OF THE PREFERRED EMBODIMENTS

The current invention applies principles developed by the inventor to provide removable LED-units or LED-assemblies with built-in LED elements having resilient/elastic or movable conductive means to add, remove, replace, insert, assemble, and/or disassemble the LED-units or LED-assemblies anywhere along the track means to achieve the most power savings, least cost, and adjustable illumination areas, thereby providing a practical and inexpensive LED light source which has a similar appearance to existing non-LED light sources, such as a fluorescent tube, incandescent bulb, PL lamp, UV-lamp, or other non-LED light source available from the marketplace.

Part of the following description was included in text boxes in the original drawings.

Figure 1:
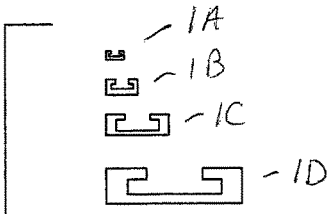
FIGS. 1-1 to 1-10 show different arrangements in three dimensions of one to eight track means to provide different light effects with a certain number of LED-units or LED-assemblies having built-in LED elements.
Figures 1, 2, 3, 4, 5:
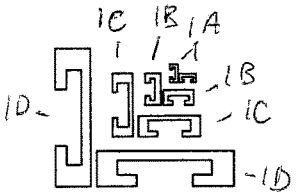
Figures 1, 2, 3, 4, 5, 6, 7, 8:
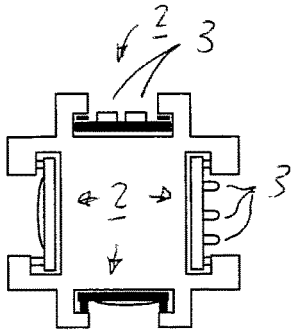
Figures 1, 2:
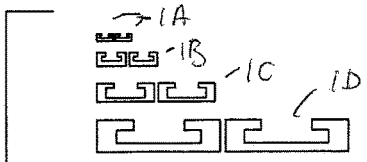
Figures 1, 2, 3, 4, 5, 6:
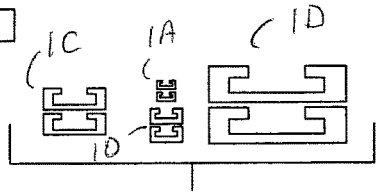
Figures 1, 2, 3:
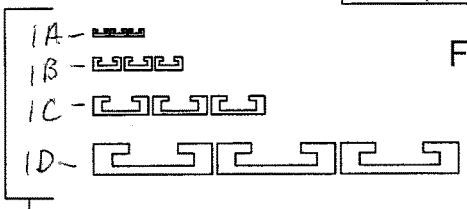

FIGS. 1-1 to 1-10 shows different arrangements of from one to eight track means. The more than one track means can have any desired geometric arrangement in three dimensions to provide different light effects for a certain number of LED-units or LED-assemblies having built-in LED elements. FIG. 1-1 shows single track means 1A-1D for providing a linear LED light device. As illustrated, the track means 1A-1D can have different sizes ranging from miniature (1A), to medium (1B), large (1C), and extra-large (1D). FIG. 1-2 shows pairs of track means 1A-1D arranged side-by-side to double the number of LED-units and therefore the brightness, which is useful for a work light. FIG. 1-3 shows groups of three of the track means 1A-1D arranged side-by-side for even greater brightness. FIG. 1-4 shows groups of four of the track means 1A-1D arranged perpendicularly to form a parallelepiped structure and provide 360° illumination. FIGS. 1-5 to 1-7 show respective L-shaped and stacked arrangements of the track means 1A-1D. The medium track means arrangements can be used for a portable LED light application, while the large size is suitable for bed, desk, camping, garden, outdoor, and indoor 360° illumination. The extra large track means arrangement can be used for floor, patio, table, bed, construction zone, door, garden, playground, swimming pool, camping, and industrial use. FIG. 1-8 shows details of the LED units 2, which include surface mount technology (SMT) LED elements 3 sealed in the units by glue, the units being electrically connected to the track means by resilient conductive means. The parallelepiped shape may be achieved by extrusion molding, and may take the form of a single three-dimensional track means or four one-dimensional track means connected together. Finally, FIGS. 1-9 and 1-10 show octagonal and hexagonal units formed by the track means 1A-1D. The LED-units installed in the track means can have any number of LEDs.

FIGS. 1-11 to 1-18 show different sizes and arrangements for the LED-units or LED-assemblies 2A-2D, which include housing means to seal each of the LED-units or LED-assemblies. FIGS. 1-11 to 1-18 also show LED-elements 3 arranged on each of the LED-units or LED-assemblies. FIG. 1-11 shows a track means 1 with a one-piece housing and also illustrates the manner in which LED-units 2A including at least one LED element 3 and conductive means 4 for electrically connecting with buses or conductors in the track means 1 are removably inserted into the track means 1.

The track means 1 can be arranged to replace an LED bulb, fluorescent tube, light bar, or CFL tube, with the properties of the light being determined by inserting light units having desired LED arrangements into the track means. As shown in FIG. 1-12, the track means 1 are joined together in an octagonal track-means made by extrusion that replaces an light tube, each track means having inserted from the ends a plurality of LED-units 2A and a pair of end LED-units 2D. FIG. 1-13 shows respective light units 2A-2C with one, two, and three LED elements 3 and resilient conductive elements 4 for establishing electrical connections with the track means, while FIGS. 1-14 to 1-16 show arrangements of multiple LED-units forming LED-assemblies of different lengths. FIG. 1-18 shows an end unit that provides an end cover for the track, and may further include built-in circuit means, sensor means, switch means, link means, or other electric parts and accessories from the marketplace. FIG. 1-17 shows, by way of example and not limitation, different ways in which the LED elements 3 can be arranged on the LED-units. The number of LEDs on each unit can be any number from one to N, and the LEDs may be arranged to provide a required brightness, color, viewing angle, light beam direction, color temperature, and area.

FIGS. 1-19 to 1-21 show additional combinations of track means 1 and LED-units 2A and 2D having resilient/elastic conductive means 4 that enable the LED-units (or LED-assemblies) to be assembled and disassembled into one or more of the track means 1 in any desired geometric combination with respect to three-dimensional (x-y-z) axes and provide predetermined light functions, performance, and light shows. The alternative track means arrangements of FIGS. 1-19 to 1-21 include a light bar (FIG. 1-19), an L-shaped arrangement for corner or wall-ceiling lighting (FIG. 1-20), and an arrangement with a square cross-section suitable for use as a desk or floor lamp (FIG. 1-21). Any of these track means arrangements can have different LED-units, as described above, and the track means or LED-units may further include display housings, shades, covers, lenses, and optics means.

FIGS. 29-33 show various light sources previously described in the inventor's U.S. Pat. No. 7,722,230, the light sources having clip-on units that may be adapted for use in connection with the track means of the present invention. The light sources include LED-units or assemblies 29*a*, 29*b*, 30, 31, and 32*a* with movable conductive means that can be clipped, added, inserted, replaced, removed, assembled, or disassembled to or from a track means at any location rather than just from ends of the track means. Further details, which are not part of the present invention, may be found in U.S. Pat. No. 7,722,230.

The current invention adds protective means to arrange all the LED-unit(s) or LED-assembly(ies) within the protective means to provide a finished light source. FIGS. 2-16 show embodiments of the current invention that include such protective means 5A and 5B, as well as LED-unit(s) or LED-assembly(ies) 6, resilient/elastic conductive means or moveable conductive means 7, and track-means 1. The LED-unit(s) or LED-assembly(ies) 6, resilient/elastic conductive means or moveable conductive means 7, and track means 1 may correspond to those illustrated in FIGS. 1-1 to 1-21, as shown in FIGS. 2 and 3, or the clip-on arrangements of FIGS. 29-32, as shown in FIG. 4. The protective means 5A and 5B illustrated in FIGS. 2-4 are in the form of a tube cover, which may be made of a transparent piece, translucent piece, and/or a tube cover provided with light passing means, stencils, masking, openings, cutouts, or windows to allow light from the LEDs to be seen by a viewer, and which can be any appropriate size. FIG. 4 also shows a bus means in the form of two or more conductive means 8 to supply electricity to LED-units or assemblies installed in the track means 1.

FIGS. 5-8 show different ways to arrange the individual LEDs or LED elements 3 or 3' to provide different light effects, including arranging adjusting the legs 9 of the LEDs 3' so that the LEDs 3' point in different directions.

FIG. 5-11 shows different geometric arrangements of the track means in three dimensions to get minimum and maximum sizes and provide desired light performance, including arrangements of 3, 4, 6, and 8 track means, with each track means having different LED-unit(s) or LED-assembly(ies) with built-in different sizes and numbers of LEDs or LED-elements.

Figures 1, 2, 3, 4, 5, 6, 7, 8, 9:
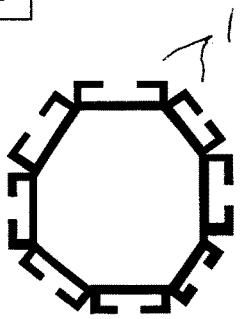
Figures 1, 2, 3, 4:
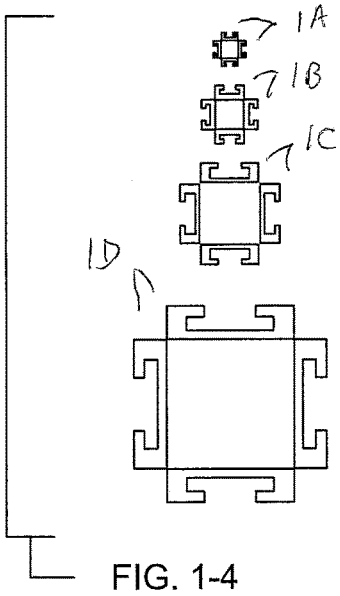
Figures 1, 2, 3, 4, 5, 6, 7:
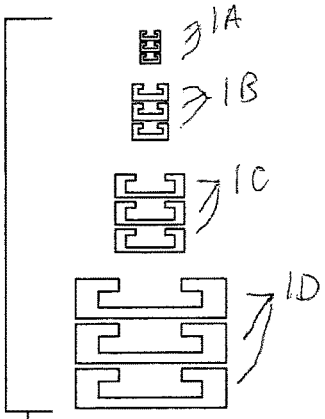
Figures 1, 2, 3, 4, 5, 6, 7, 8, 9, 10:
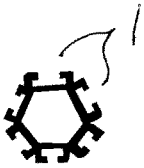
Figures 1, 2, 3, 4, 5, 6, 7, 8, 9, 10, 11, 12, 13, 14, 15, 16, 17, 18:
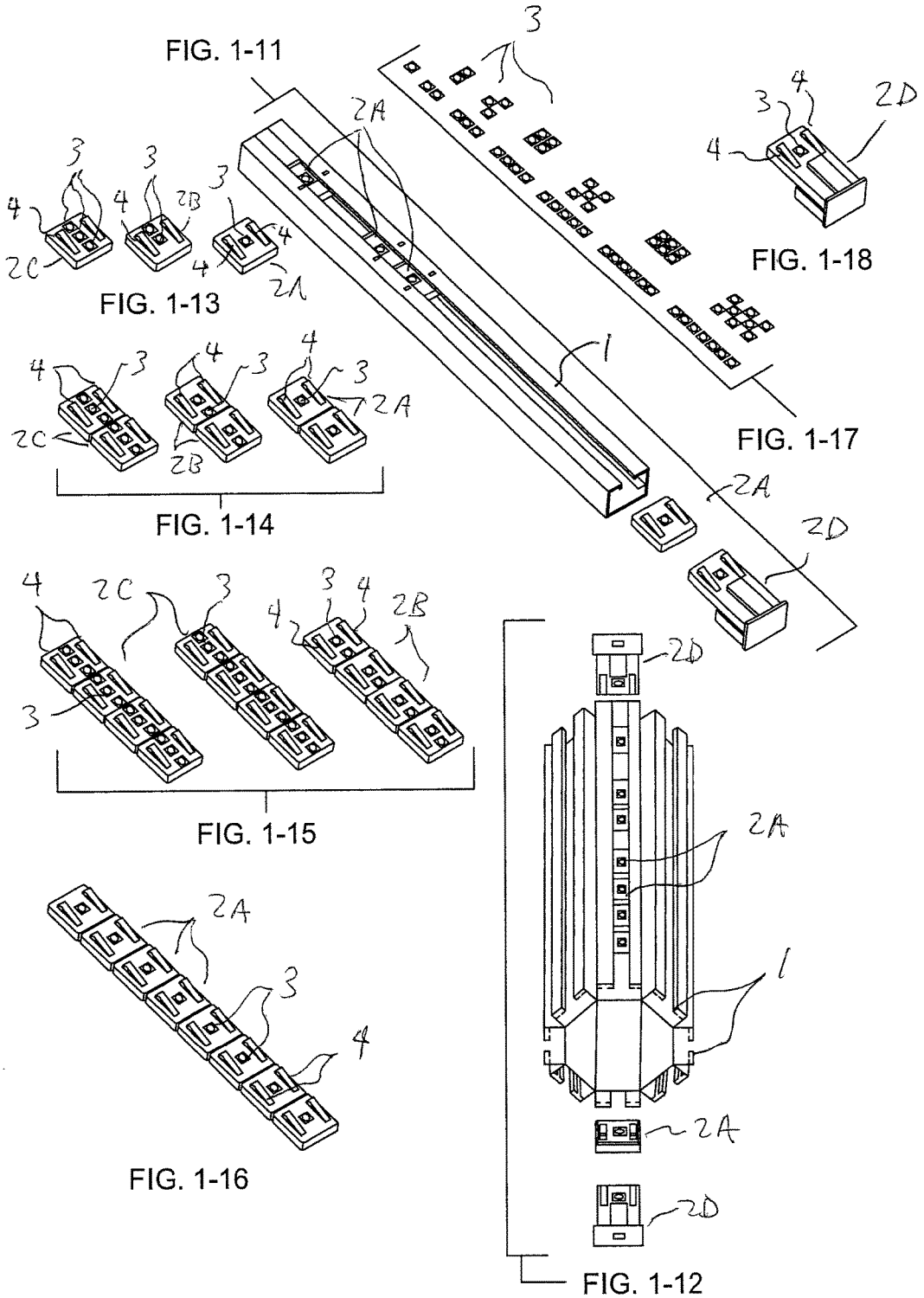
Figures 1, 2, 3, 4, 5, 6, 7, 8, 9, 10, 11, 12, 13, 14, 15, 16, 17, 18, 19:
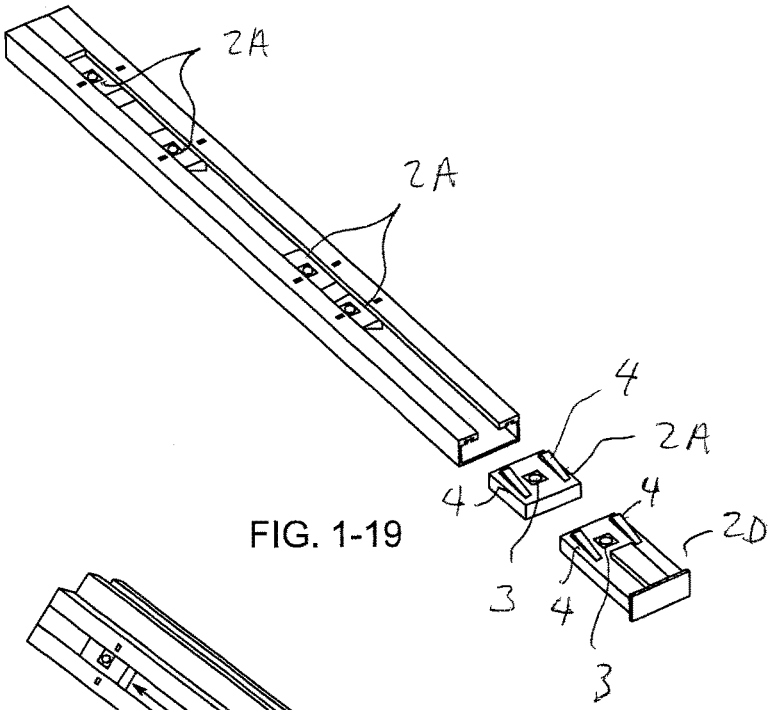
Figures 1, 2, 3, 4, 5, 6, 7, 8, 9, 10, 11, 12, 13, 14, 15, 16, 17, 18, 19, 20:
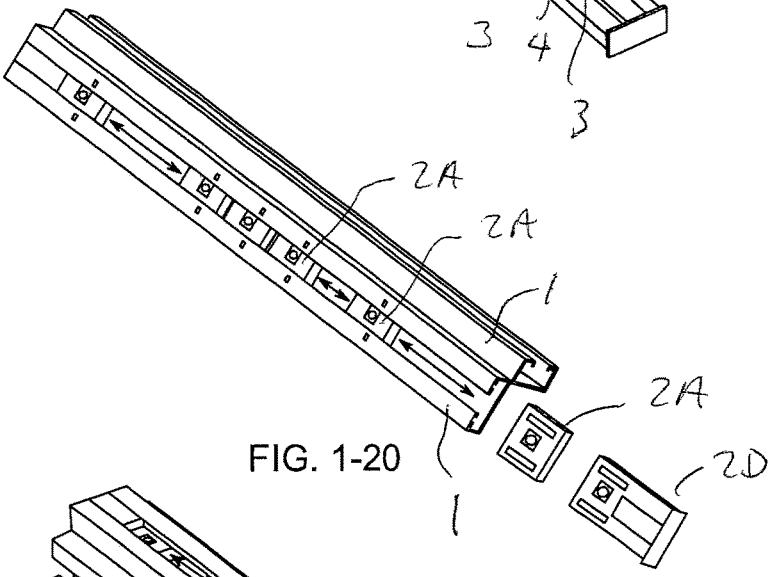
Figures 1, 2, 3, 4, 5, 6, 7, 8, 9, 10, 11, 12, 13, 14, 15, 16, 17, 18, 19, 20, 21:
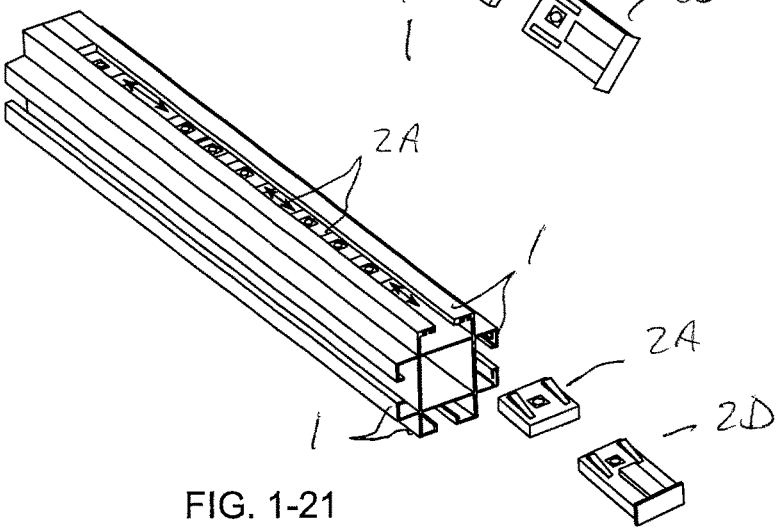
Figure 29:
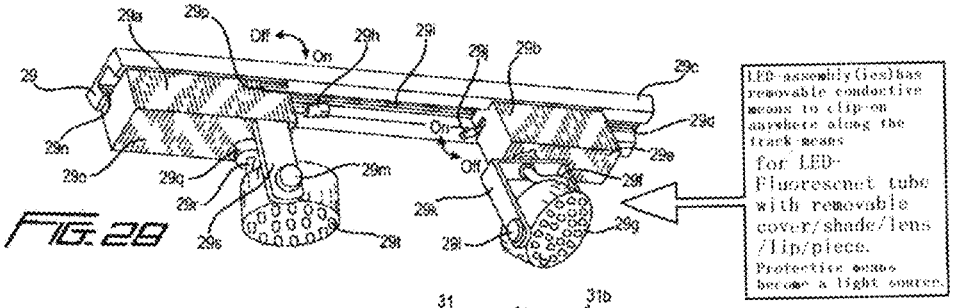
FIGS. 29 to 33 show an embodiment of the current invention in which a light source includes LED-units or LED-assemblies with movable conductive means to clip, add, insert, replace, remove, assemble, or disassemble the LED-units or LED-assemblies anywhere along the track means, and protective means in which all of the LED-units or LED-assemblies are arranged to provide a finished light source.
Figure 30:
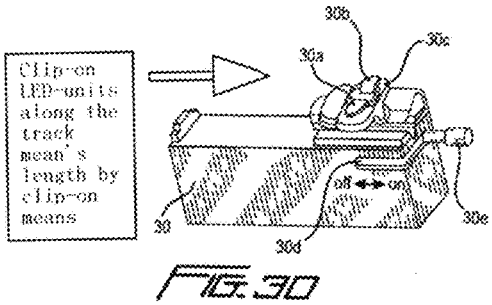
Figure 31:
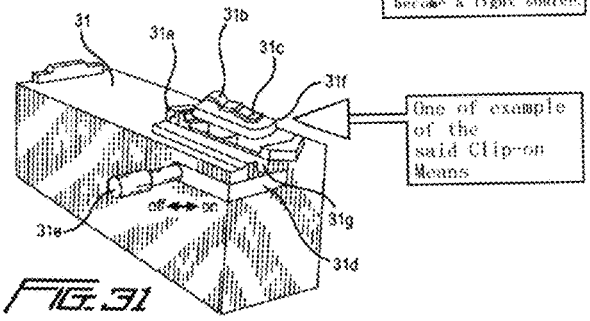
Figure 32:
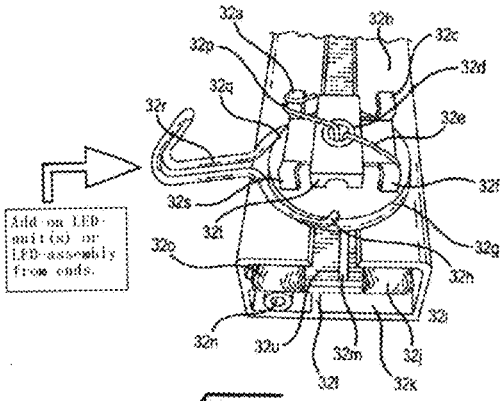
Figure 33:
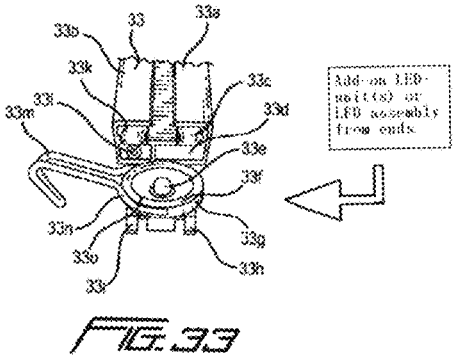
Figure 2:
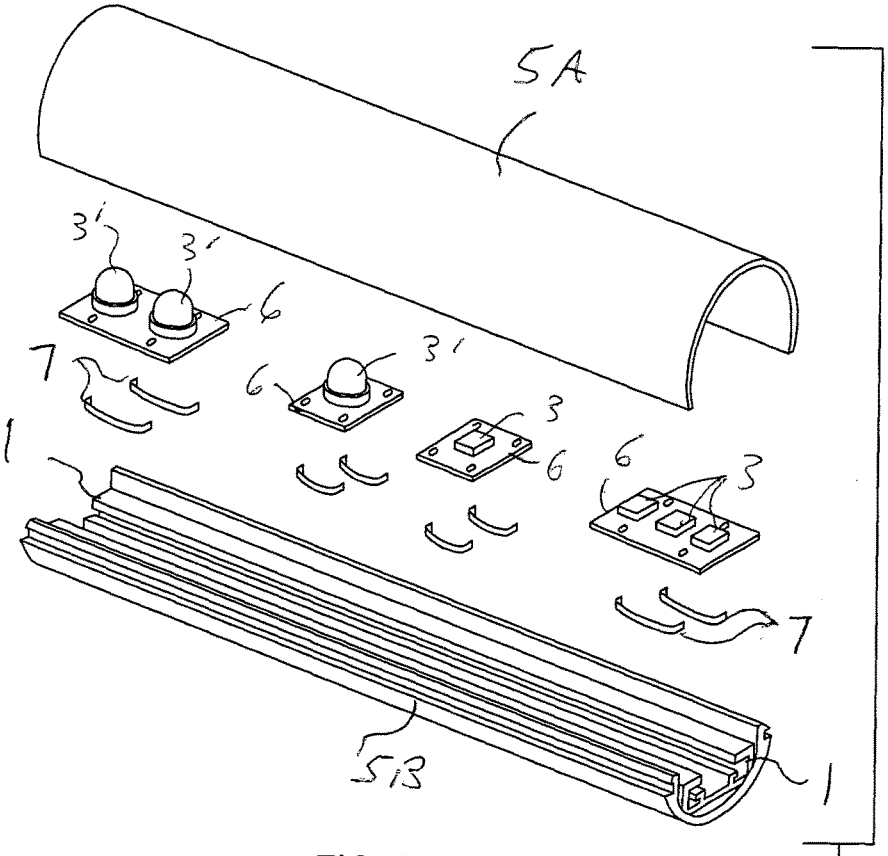
Figure 3:
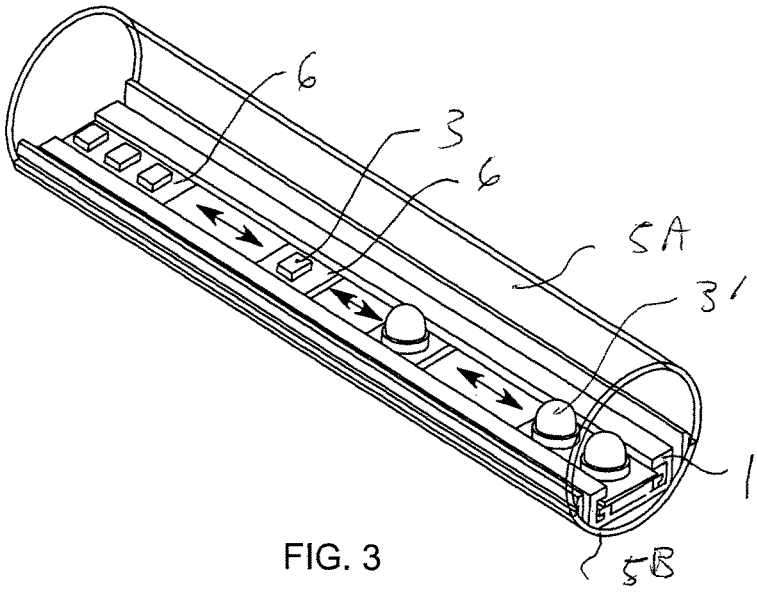
Figure 4:
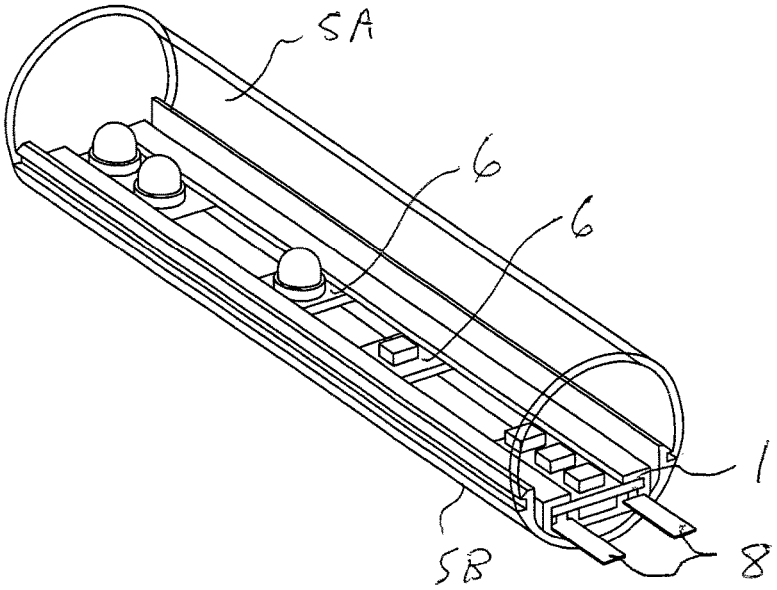
Figures 5, 6, 7, 8:
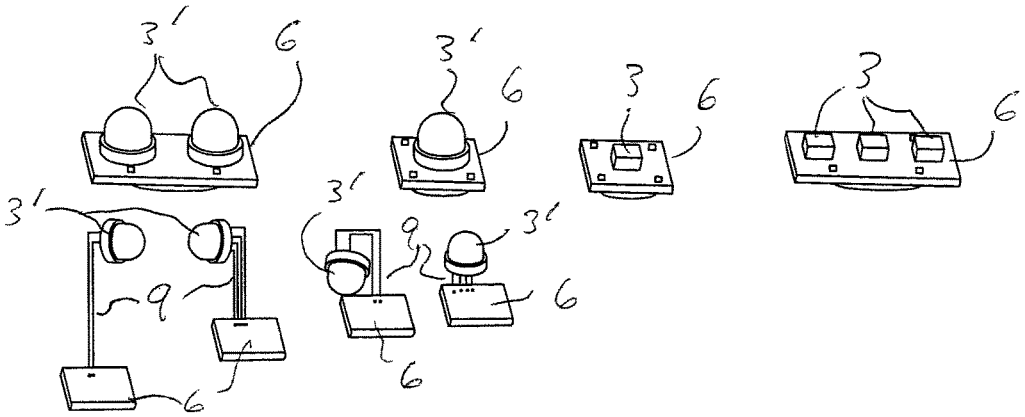
Figure 9:
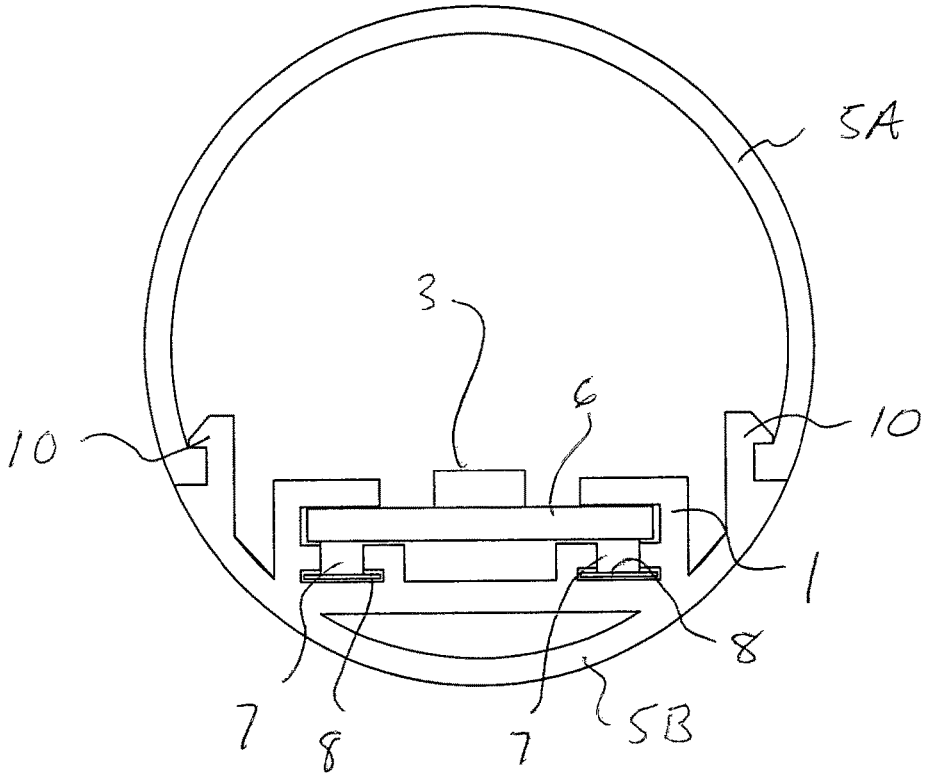
Figure 10:
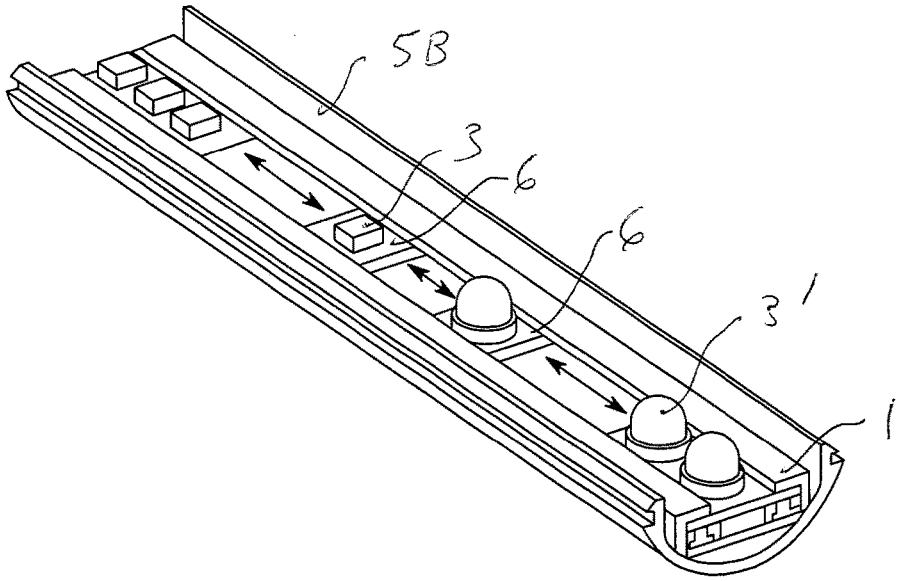
Figure 11:
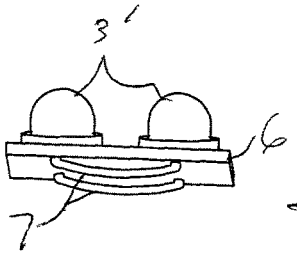
Figure 12:
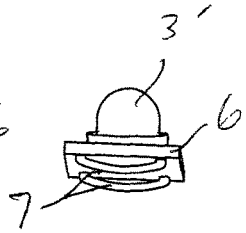
Figure 13:
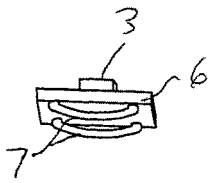
Figure 14:
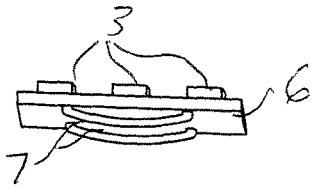
Figure 15:
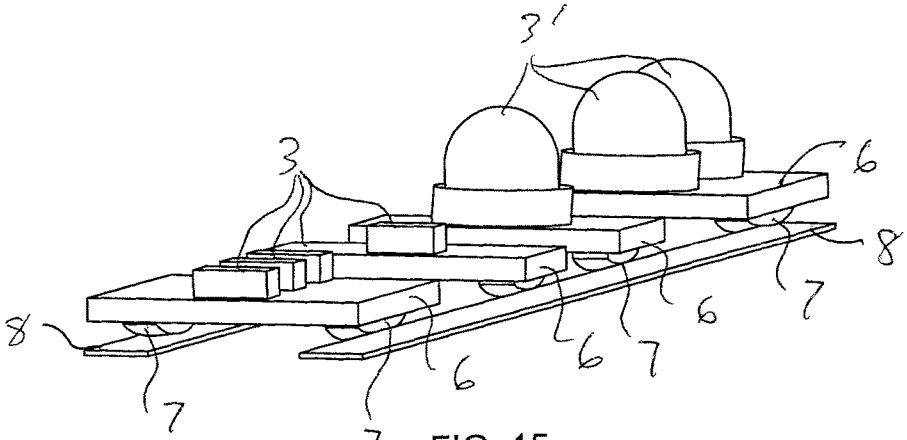
Figure 16:
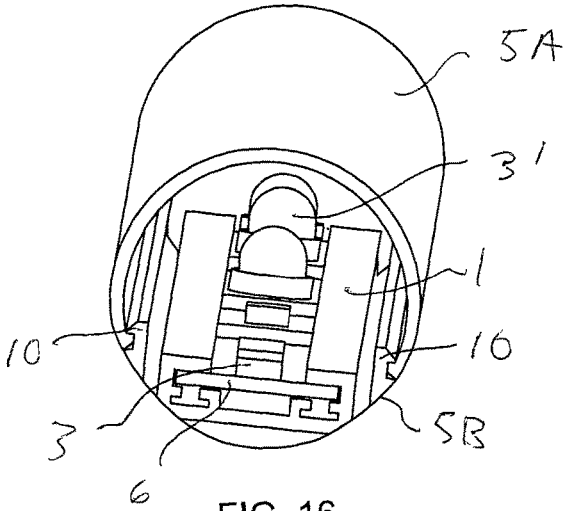
Figures 5, 6, 7, 8, 9, 10, 11:
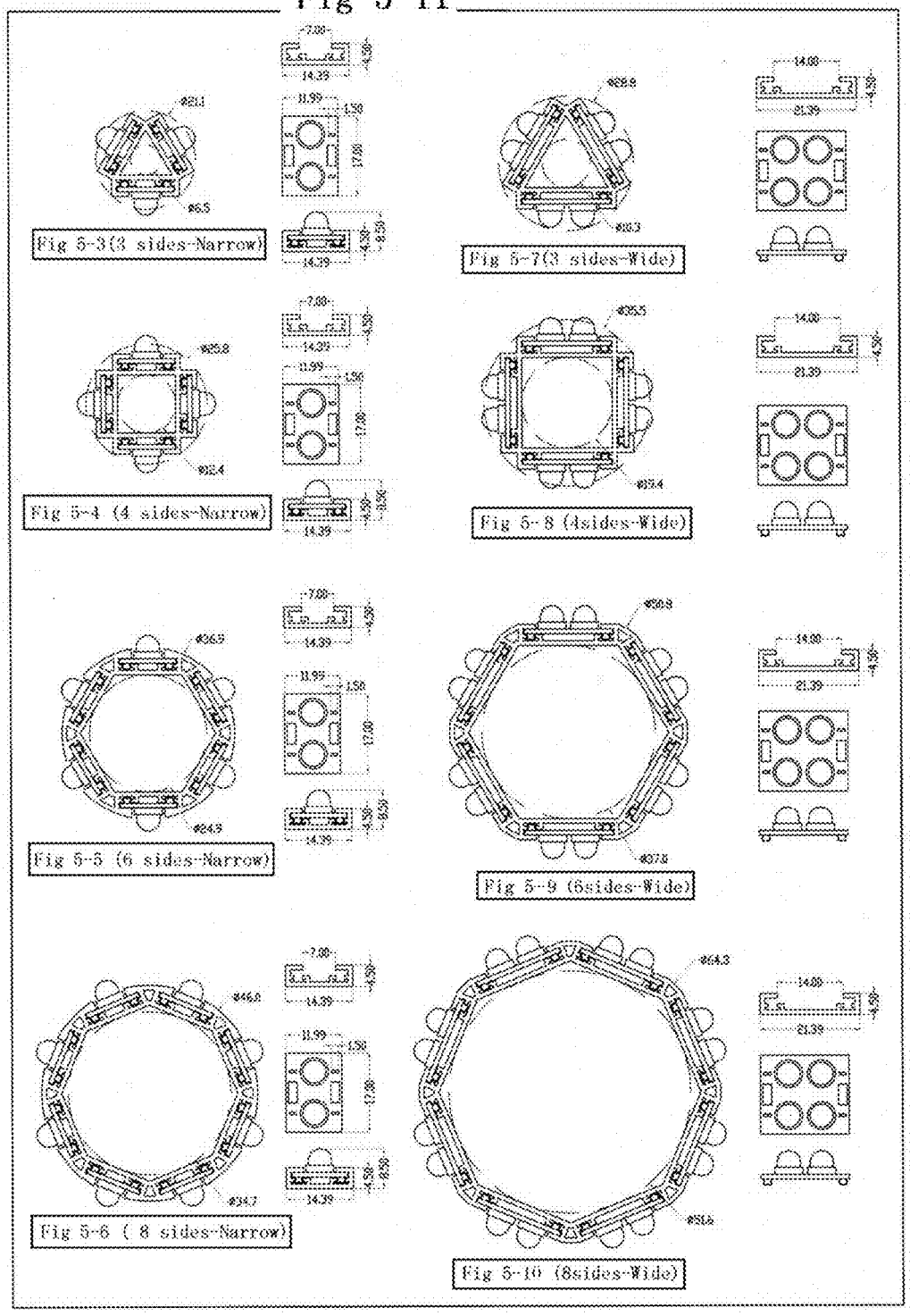

FIGS. 9 and 10 shows a track means 1 with a hook-shaped catch arrangement 10 to clip a protective means 5A onto a track means 1, the track means 1 being integrated with protective means 5B including grooves for printed circuit boards of the LED units, each LED unit including LED elements of any type. The track means/protective means further includes grooves for bus means 8 that provide electric signals, the bus means being electrically connected to the circuit boards of individual LED units by resilient/elastic conductive means 7. FIGS. 11-15 show individual LED units 6 and conductive means 7 for use in the embodiment of FIGS. 9 and 10. Finally, FIG. 16 shows an arrangement similar to that of FIGS. 9 and 10, but in the form of a tube.

Each of the illustrated embodiments may also have any of the following features:

At least one of the LED-units or LED-assemblies may have circuitry and parts that provide a predetermined brightness, color, direction, viewing angle, and illumination area, when the respective LED-unit or assembly are added, replaced, or removed from anywhere along the track-means or from ends of the track means and electrically connected to the track means by elastic or movable conductive means to the circuitry and parts enabling the LED element(s) to turn-on and turn-off according to predetermined functions, performance, and duration. Alternatively, at least one of the LED-units may lack the trigger circuitry and parts and instead getting the LED trigger electric signal directly from the track means as an input-signal, the track-means having at least one positive and one negative electric bus-means to supply the electric signal to the LED elements to provide a desired performance, function, light show, and duration.

The LED-units or LED-assemblies can be added, removed, moved, assembled to, or disassembled from anywhere along the track means by any of a variety attachment means, including clip-on, twist-on, bend-on, magnetic, screw-on, insert-type or other attachment means.

In addition, the LED-units or LED-assemblies, or the light device may have any geometric design, shape, size, cover, housing, isolation body, cover, safety screw, holding-area(s), to allow people to directly or indirectly touch the LED-units or LED-assemblies when moving the units or assemblies, changing position, and/or adding, reducing in number, removing, assembling the units assemblies to, or disassembling the units or assemblies from the track means.

The protective-means of the preferred light device may include a housing, cover, lid, shade, plastic piece, transparent piece, translucent piece, areas, windows, opening(s), and/or cut-out areas.

The track-means can made of a plastic or metal material.

The LED Light device may take the form of an LED fluorescent tube, LED Bulb, LED PL lamp, or any other shape, design, or appearance similar to a conventional non-LED fluorescent tubes, incandescent bulbs, PL lamp, halogen lamp, or gas-filled lamp.

The removable LED-units may be clipped-on anywhere along the length or added—on from ends of the track means using movable conductive means that can change from position A to position B, or to more positions, to enable the conductive means to deliver electricity from the track means to the LED units or disconnect LED units from the track means. Alternatively electric connection may be achieved by elastic conductive means that change shape when force is applied thereto but which still enable electricity delivery at any time while within the track means. The conductive means may include any combination one of or combination of a conductive piece, plate, spring, strips, wires, and conductive printing material capable of delivering an electric signal from one place to another place.

The removable LED-units or LED-assemblies across a person's head-width to illuminate a shoulder-width area and save power, reduce the number of LED-elements, and save money.

The track means can have more than one positive or more than one negative bus-means, each made of a conductive material, to connect with multiple electric terminals of a light source. In addition, more than one track means may be provided in a desired geometric arrangement with respect to the x-y-z axes of a three-dimensional coordinate system The protective means may have any size, dimension, or area to meet market requirements, and the LED-elements can be any market-available type of LED-element, in any size, number of colors, number of electric terminals, brightness, and diameter, with any lifespan and functions.

It is to be appreciated that all the above-discussed or referred-to embodiments, variations, and so forth may include additional features, including those described in the Inventor's above-cited copending applications and prior patents, including alternative parts and accessories or equivalent-function parts and accessories, and still fall within the scope of the current invention.

The invention claimed is:

1. A light device, comprising:

at least one track means for removably installing at least one LED-unit anywhere along a length of the track means or adding the at least one LED-unit from an end of the track means;

the at least one LED-unit including at least one LED-element, said at least one LED-element having at least one of a predetermined brightness, color, illumination direction, viewing angle, and illumination area;

the at least one LED-unit also including resilient or movable conductive means for electrically connecting circuitry in the at least one LED-unit to bus means in the at least one track means to cause the at least one LED-element to turn on and off according to predetermined functions, performance, and duration; and the at least one LED-unit being arranged to be installed anywhere along the length of the at least one track means or inserted into the at least one track means from the end of the at least one track means, the LED-unit having a geometric shape, size, cover, housing, insulation, and holding areas that allow a person to manipulate the at least one LED-unit so as to move, change position, add, remove, assemble, or disassemble the at least one LED-unit to or from the at least one track means; and protective means for protecting the track means and LED-units, said protective means selected from a housing, cover, lid, and shade that encloses both said track means and LED-units to form an LED light device that resembles and replaces an existing non-LED light device, wherein said protective means includes first and second protective members, the second protective member being integrally combined with the track means, wherein said first protective member is secured to the second protective member by at least one hook-shaped catch, and wherein said first and second protective members together form a tube or bulb shaped protective member enclosing said track means and said at least one LED-unit.

* * * * *